United States Patent [19]

Nishibe et al.

[11] 4,186,643

[45] Feb. 5, 1980

[54] APPARATUS FOR CHORUS EFFECT IN ELECTRONIC MUSICAL INSTRUMENTS

[75] Inventors: Kouji Nishibe, Okegawa; Nobuaki Kondo, Saitama, both of Japan

[73] Assignee: Kabushiki Kaisha Kawai Gakki Seisakusho, Hamamatsu, Japan

[21] Appl. No.: 900,645

[22] Filed: Apr. 26, 1978

[30] Foreign Application Priority Data

Feb. 7, 1978 [JP] Japan ..... 53-11988

[51] Int. Cl.[2] ..... G10H 1/06; G10H 5/00

[52] U.S. Cl. ..... 84/1.24; 84/1.25; 84/DIG. 4; 179/1 J; 333/165

[58] Field of Search ..... 84/1.24, 1.25, DIG. 4; 179/1 D, 1 J, 1 M; 333/29, 165

[56] References Cited

U.S. PATENT DOCUMENTS 4,000,676 1/1977 Love ..... 84/1.25

FOREIGN PATENT DOCUMENTS 52-38888 10/1977 Japan ..... 84/1.24

*Primary Examiner*—S. J. Witkowski

*Attorney, Agent, or Firm*—Haseltine, Lake & Waters

[57] ABSTRACT

Apparatus for chorus effect in an electronic musical instrument in which a passing circuit for a musical tone signal is obtained from a musical tone signal generator by operation of a key. The passing circuit is connected to a plurality of variable delay circuits which are individually controlled by a plurality of delay control signals generated by a delay control signal generator. The passing circuit for the musical tone signal has a format filter, as well as a keying signal generating circuit. An output terminal of this keying signal generating circuit is connected to a voice production initial stage change control signal generator. The latter control signal generator has an output terminal connected to the musical tone signal generator or the delay control signal generator. The voice production initial stage change control signal generator, furthermore, has a network which generates a control signal which is largely disordered from its steady state and is then damped to restore to the steady state, upon application of a keying signal generated from the keying signal generating circuit. The voice production initial stage change control signal generator, may include a low frequency oscillator for generating a vibrato signal which is disordered by a keying signal generated by the keying signal generating circuit.

8 Claims, 21 Drawing Figures

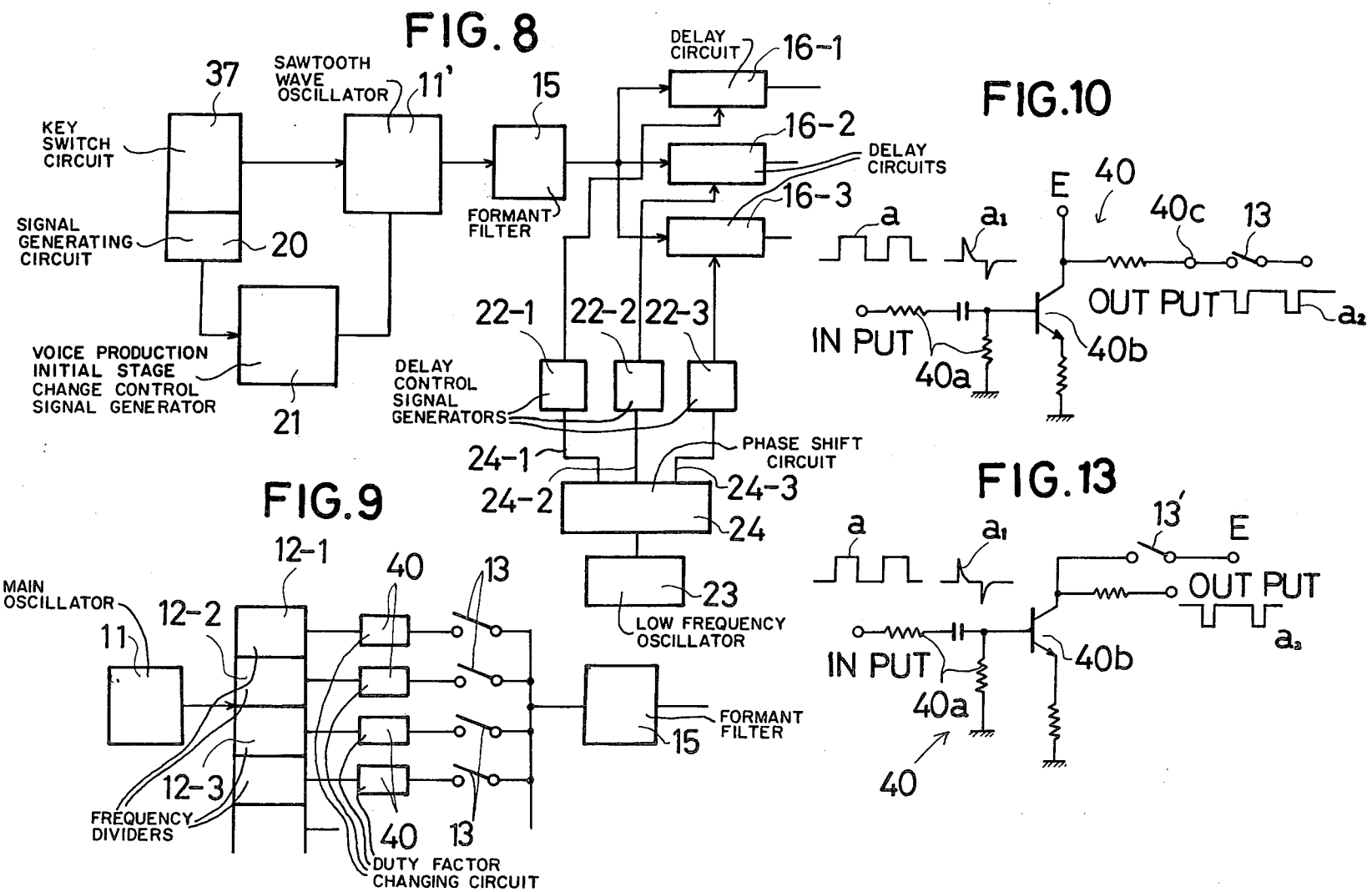
FIG. 8
FIG. 9
FIG. 10
FIG. 13
KEY SWITCH CIRCUIT
SIGNAL GENERATING CIRCUIT
VOICE PRODUCTION INITIAL STAGE CHANGE CONTROL SIGNAL GENERATOR
SAWTOOTH WAVE OSCILLATOR
FORMANT FILTER
DELAY CIRCUIT
DELAY CIRCUITS
DELAY CONTROL SIGNAL GENERATORS
PHASE SHIFT CIRCUIT
LOW FREQUENCY OSCILLATOR
FORMANT FILTER
MAIN OSCILLATOR
FREQUENCY DIVIDERS
DUTY FACTOR CHANGING CIRCUIT
IN PUT
OUT PUT
E
a
a1
a2
37
20
21
11'
15
16-1
16-2
16-3
22-1
22-2
22-3
24-1
24-2
24-3
24
23
11
12-1
12-2
12-3
13
13'
40
40a
40b
40c

APPARATUS FOR CHORUS EFFECT IN ELECTRONIC MUSICAL INSTRUMENTS

BACKGROUND OF THE INVENTION

This invention relates to an apparatus for a chorus effect in an electronic musical instrument.

There is already known in the art an arrangement where, as shown in FIG. 1, a passing circuit 1 for a musical tone signal is provided with a tone color filter 2 interposed therein and an output terminal of the filter is diverged to plural delay circuits 3-1 . . . 3-3, and the output terminals thereof are connected to speakers 6-1 . . . 6-3 through low-pass filters 4-1 . . . 4-3 and amplifiers 5-1 . . . 5-3, respectively. The delay circuits 3-1 . . . 3-3 are arranged to be controlled by switching oscillators 7-1 . . . 7-3. Numeral 8 denotes a low frequency oscillator, and an output terminal thereof is connected to the switching oscillators 7-1 . . . 7-3 through a phase-shift circuit 9. An ensemble effect can be obtained as a result of the fact that the delay circuits 3-1 . . . 3-3 are given periodically delay changes by such respective pulses generated from the switching oscillators 3-1 . . . 3-3 that are changed in cycle and different in phase from one another. (See: Japanese Patent Publication Sho 52-38888).

This arrangement is comparatively excellent in ensemble effects such as for strings, brasses or similar instruments but it is difficult to obtain a chorus effect of a human voice.

It is, therefore, an object of the present invention to provide an apparatus for obtaining a chorus effect very similar to the human voice.

Another object of the present invention is to provide apparatus of the foregoing character which is substantially simple in construction and may be economically fabricated.

A further object of the present invention is to provide an arrangement, as described, which may be readily maintained in service and which has a substantially long operating life.

SUMMARY OF THE INVENTION

The objects of the present invention are achieved by providing that a passing circuit for a musical tone signal obtained from a musical tone signal generator by operation of a key is connected to plural variable delay circuits. These delay circuits are arranged to be individually controlled by plural delay control signals generated from a delay control signal generator. The passing circuit for the musical tone signal is provided with a formant filter interposed therein and is also provided with a keying signal generating circuit; an output terminal of the keying signal generating circuit is connected to a voice production initial stage change control signal generator, and an output terminal of the voice production initial stage change control signal generator is connected to the musical tone signal generator or the delay control signal generator.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 8 is a block diagram of another embodiment of this invention;

FIG. 9 is a block diagram of a further embodiment of this invention;

FIG. 10 is a circuit diagram of a duty factor changing circuit;

FIG. 13 is a circuit diagram in which the duty factor changing circuit is used as a gate circuit;

FIG. 14A is a further embodiment of the circuit arrangement of FIG. 14;

DESCRIPTION OF THE PREFERRED EMBODIMENTS

Figure 1:
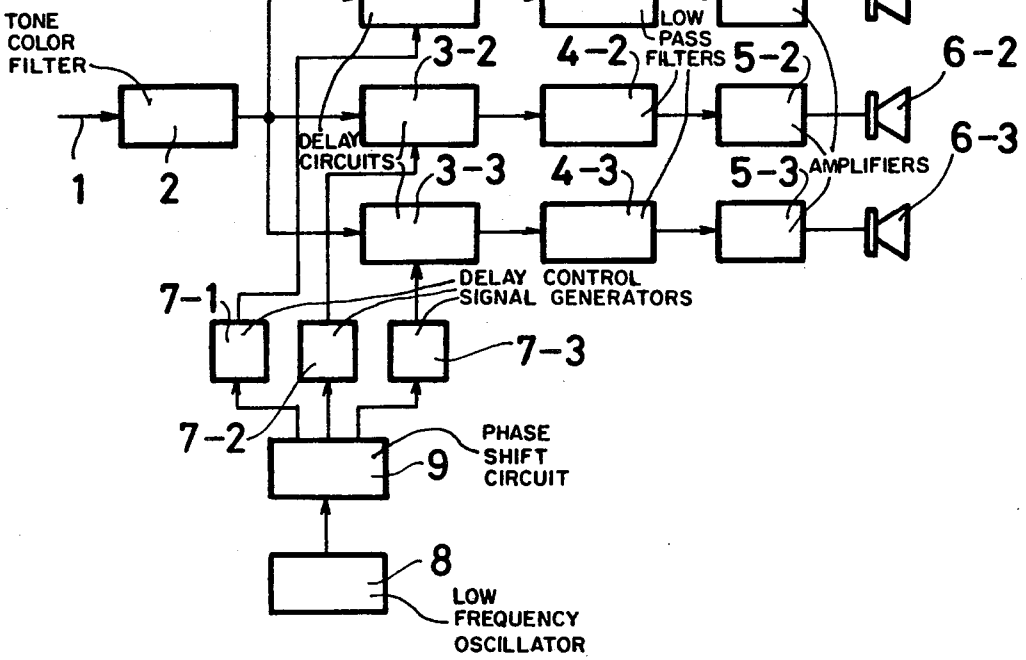
FIG. 1 PRIOR ART
FIG. 1 is a block diagram of a conventional apparatus.
Figure 2:
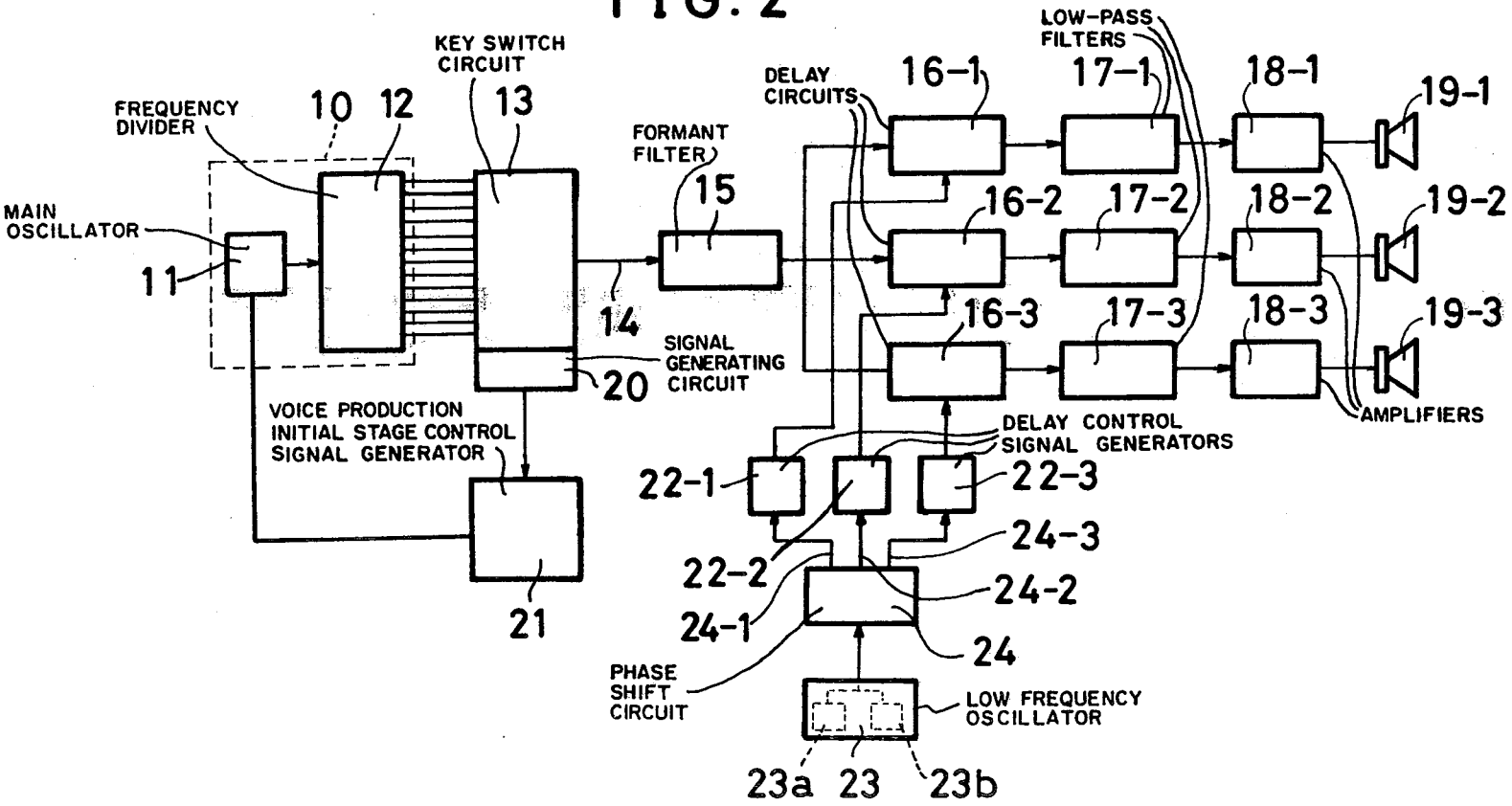
FIG. 2 is a block diagram showing one embodiment in accordance with the present invention.

Referring to FIG. 2, numeral 10 denotes a musical tone signal source comprising a main oscillator 11 and a frequency divider group 12, and plural output terminals thereof are connected in common through a key-switch circuit 13, and a single common output terminal 14 of the circuit 13 is connected to a formant filter 15. An output terminal of the filter 15 is diverged to plural delay circuits 16-1 . . . 16-3, and these delay circuits 16-1 . . . 16-3 are connected to speakers 19-1 . . . 19-3 through low-pass filters 17-1 . . . 17-3 and amplifiers 18-1 . . . 18-3, respectively.

Numeral 20 denotes a keying signal generating circuit provided on one side of the key-switch circuit 13, and an output terminal thereof is connected to a voice production initial stage change control signal generator 21, and an output terminal of the generator 21 is connected to a control electrode of the main oscillator 11. As for the delay circuits 16-1 . . . 16-3, a BBD (Bucket Brigade Device) or a CCD (Charge Coupled Device) is used.

Numerals 22-1 . . . 22-3 denote delay control signal generators comprising voltage-controlled type clock pulse oscillators, and their output terminals are connected to control electrodes of the delay circuits 16-1 . . . 16-3.

Numeral 23 denotes a low frequency oscillator, and its output terminal is connected to a phase-shift circuit 24, and its plural output terminals 24-1 . . . 24-3 are connected to control electrodes of the delay control signal generators 22-1 . . . 22-3. With low frequency signals which are obtained at the output terminals 24-1 . . . 24-3 and are different from each other in phase by 120 degrees each, the delay control signal generators 22-1 . . . 22-3 are controlled, and with their clock pulse frequency thus controlled, the delay controls of the delay circuits 16-1 . . . 16-3 are effected.

Figure 3:
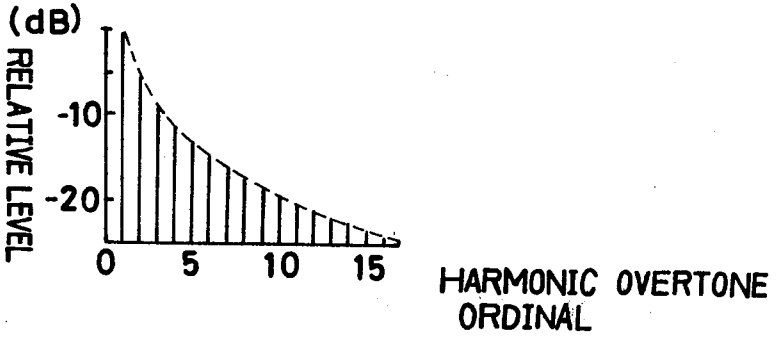
FIG. 3 is a diagram showing a harmonic overtone configuration of a sawtooth wave.

The main oscillator 11 is a sawtooth wave type oscillator, and the frequency dividers of the frequency divider group 12 are sawtooth wave type frequency dividers, and it is known that a sawtooth wave includes "n" ordinal harmonic overtones as shown in FIG. 3.

When meanwhile, a sound "A" in Roman reading produced by the human voice is analyzed, it has been confirmed that the relative levels of the harmonic overtone spectrums are comparatively high at points at or near 800 Hz, 1200 Hz, 2600 Hz and 3200 Hz, respectively.

The formant filter 15 is composed of four filters 15-1 . . . 15-4, and the resonance points of these filters 15-1 . . . 15-4 are set to 800 Hz, 1200 Hz, 2600 Hz and 3200 Hz.

Figure 5:
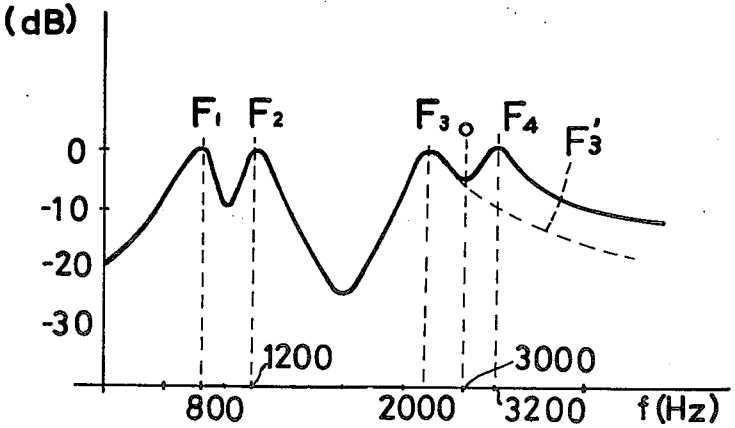
FIG. 5 is a diagram showing resonance characteristics of filter of FIG. 4.
Figure 4:
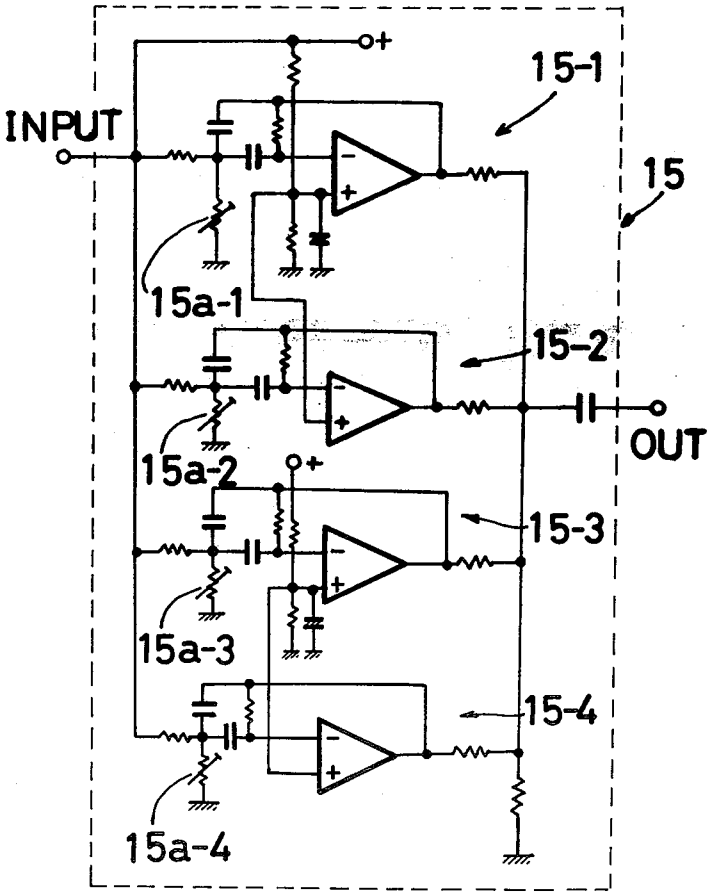
FIG. 4 is a circuit diagram of one example of a formant filter.

FIG. 4 shows one example in which the respective filters each comprises an operational amplifier, and the resonance frequencies thereof are set by adjusting respective resistances **15*a*-1 . . . 15*a*-3. The entire characteristic of the formant filter is as shown in FIG. 5**.

Now, when a musical tone signal, that is, a sawtooth wave generated by operation of a key passes through the formant filter 15, and passes through the respective delay circuits 16-1 . . . 16-3, and drives the speakers 19-1 . . . 19-3 through the low-pass filters 17-1 . . . 17-3 and the amplifiers 18-1 . . . 18-3, there can be obtained a chorus effect comparatively closely similar to the voice sound "A".

However, the chorus tone becomes somewhat unnatural, because especially in the initial stage of the producing of the voice sound of "A", the mode of the voice production is different from that of the voice production of the human voice.

Namely, a human function in producing of the voice sound of "A" is carried out in such a mode that in the initial stage pronunciation begins with such a pitch that is comparatively largely deviated from or fluctuated from a predetermined pitch and thereafter the person, while listening to that deviated pitch, approaches that predetermined pitch.

Figure 6:
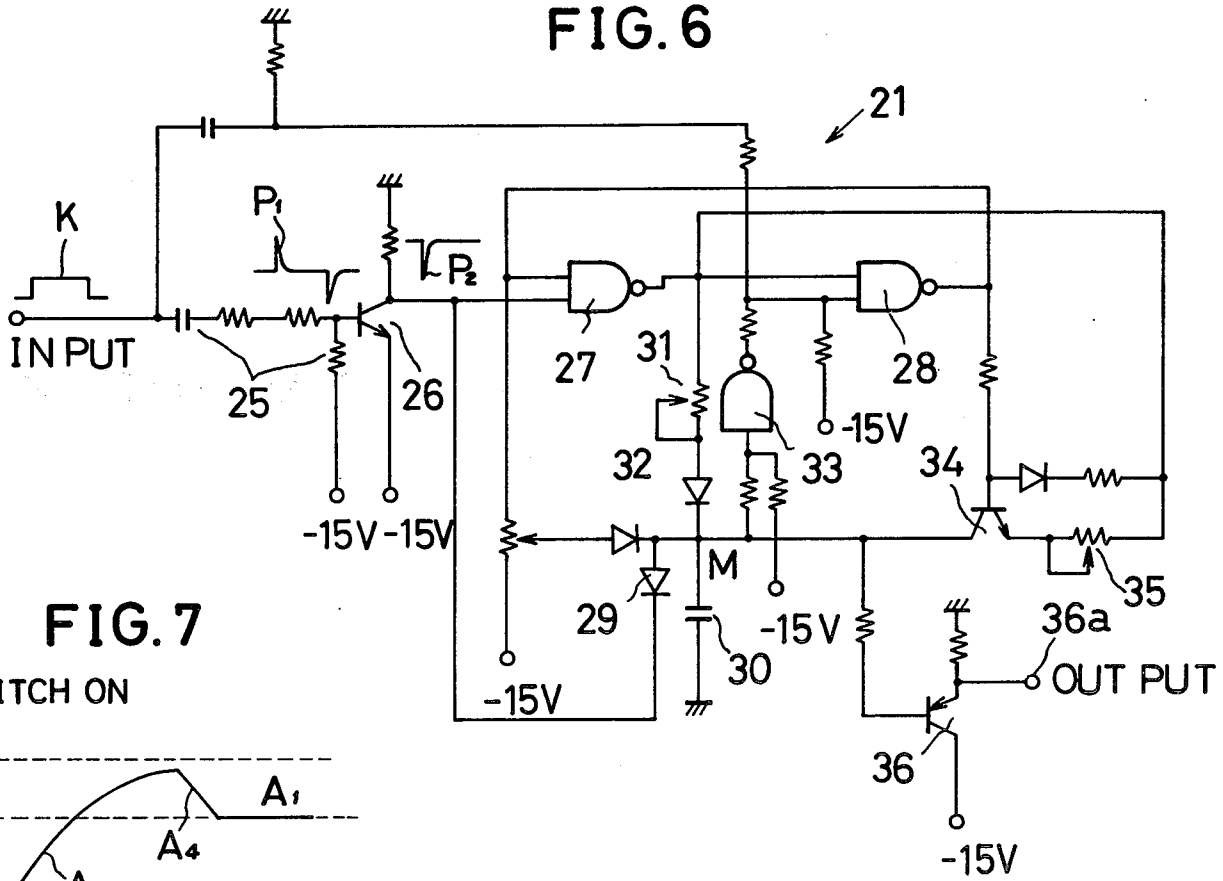
FIG. 6 is a circuit diagram of a voice production initial stage change control signal generating circuit.
Figure 7:
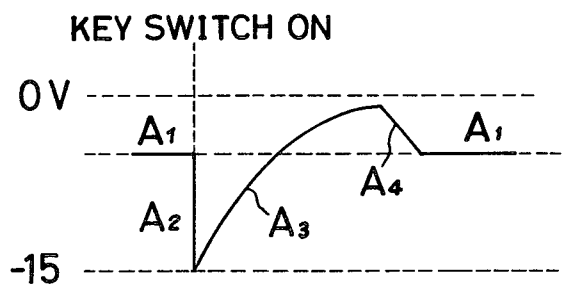
FIG. 7 is a diagram showing output characteristics of circuit of FIG. 6.

The voice production initial stage change control signal generating circuit 21 is to carry out that function, and a first embodiment is constructed as shown in FIG. 6 so as to obtain a control signal as shown in FIG. 7. Namely, if a keying signal k is the input, the signal is differentiated by a differentiation circuit 25, and a pulse $P_1$ at the front stage thereof is inverted by a transistor 26 to a pulse $P_2$. Thus, a NAND circuit 27 becomes "1" (OV) in output and a NAND circuit 28 becomes "0" (−25 V) in output, and a diode 29 becomes conducting, whereby the potential at a point M of a condenser 30 is given such a drop change from a steady state $A_1$ to $A_2$ in FIG. 7 that it is suddenly dropped to −15 V. By the output "1" (OV) of the NAND circuit 27 as a result of disappearance of the pulse $P_2$, the condenser 30 is charged through a resistance 31 and a diode 32 so as to come near OV as shown by $A_3$ in FIG. 7.

If, next, the potential of the point M approaches OV, the input voltage of a NAND circuit 33 (acting as an inverter) reaches a threshold level, so that an output thereof is inverted to "0" (−15 V), and as a result the output of the NAND circuit 27 becomes "0" and the output of the NAND circuit 28 becomes "1". Consequently, the transistor 34 turns ON and the condenser 30 discharges until it has such a potential determined by a variable resistance 35 as shown by $A_4$ in FIG. 7 so as to restore to the steady state $A_1$. The above change of $A_1$ . . . $A_4$, $A_1$ is taken from an output terminal **36*a* through a transistor 36 and is applied to the control electrode of the main oscillator 11**.

Accordingly, the oscillation frequency of the main oscillator 11 is given such a change that there is a comparatively large decrease from the steady oscillation frequency at the moment when a key is depressed, and then this oscillation frequency approaches and goes beyond the steady state according to the curve portion $A_3$, and is then turned over to become near the steady state again according to the curve portion $A_4$ so as to be settled in the steady state $A_1$. This frequency change is very similar to such a mode of producing of the human voice that the initial voice sound is adjusted to that of a predetermined tone pitch while being heard as mentioned before, and thus achieves a chorus effect tone, that closely resembles the human voice.

Figure 2A:
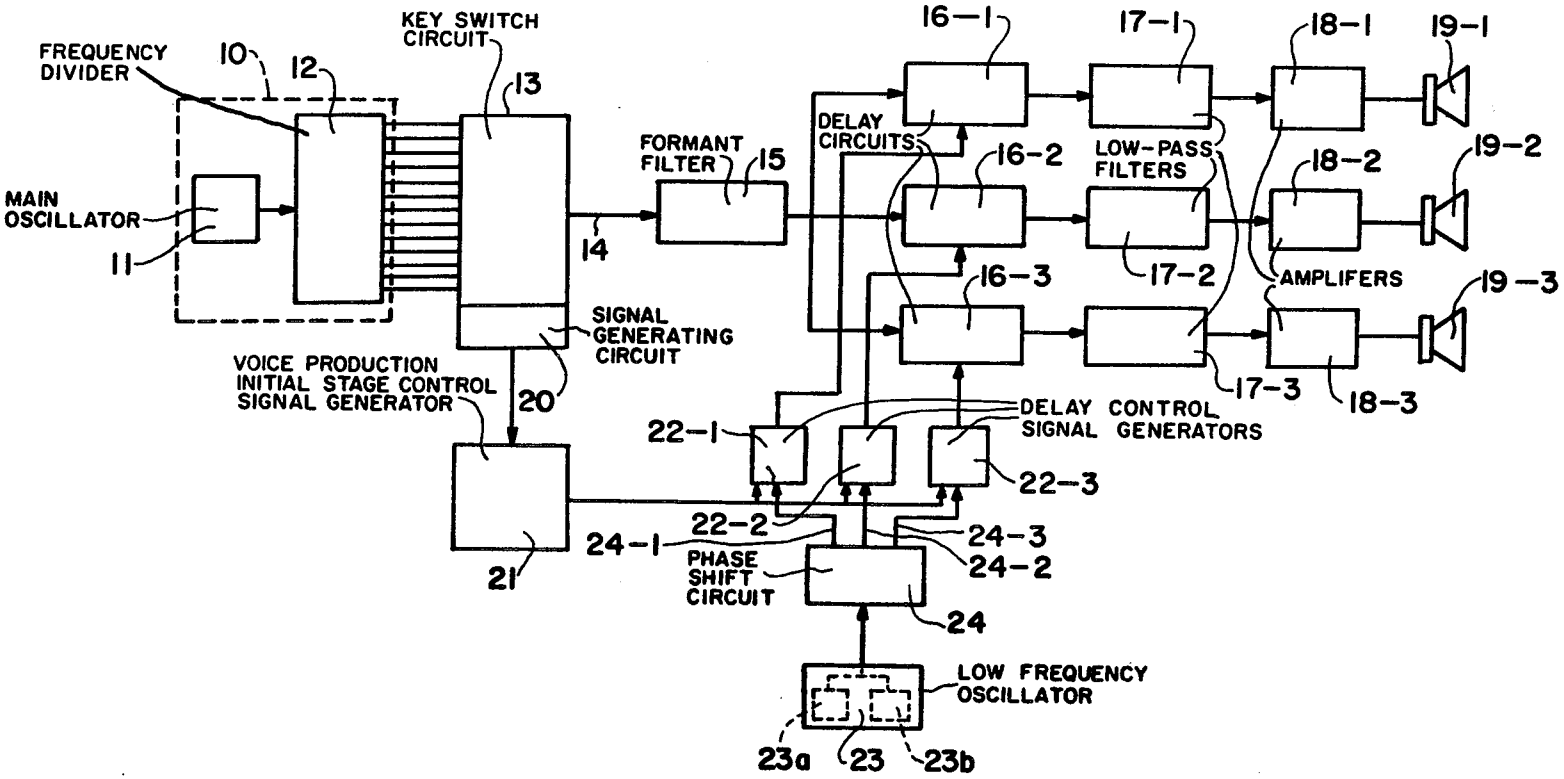
FIG. 2A is a block diagram showing another embodiment in accordance with the present invention.
Figure 4A:
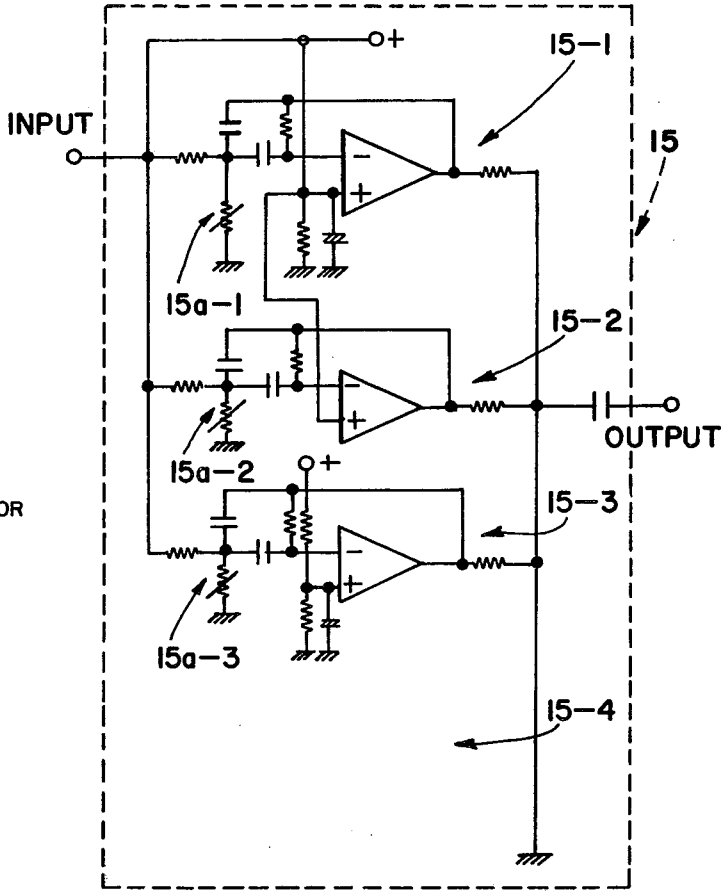
FIG. 4A is a circuit diagram of another formant filter.
Figure 8A:
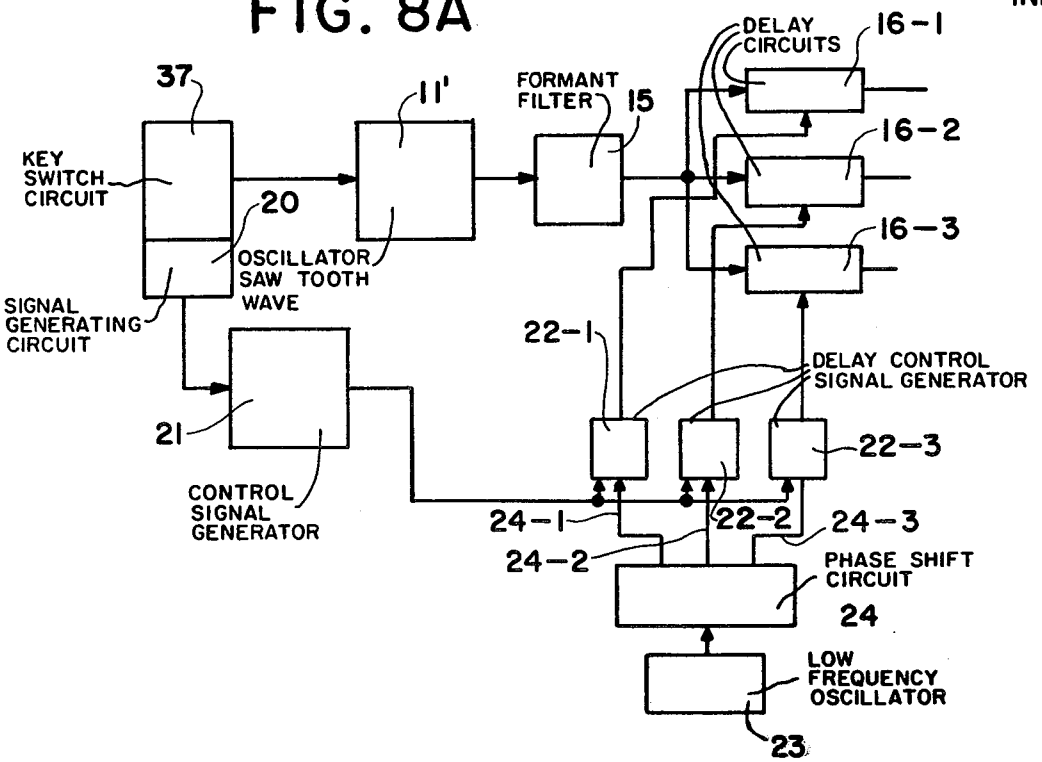
FIG. 8A is a block diagram of another embodiment of this invention.

The above has been explained for the example of the type where the oscillation frequency of the main oscillator 11 is frequency-divided. However, substantially the same effect can be obtained also in an example of the type where a synthesizer uses such a voltage-controlled type oscillator 11' that the oscillation frequency is controlled by changing an output voltage of a key-switch circuit 37 as shown in FIG. 8. This oscillator 11' is a sawtooth wave type oscillator. Almost the same voice production initial stage change as described above can be obtained, by connecting the output terminal of the voice production initial stage change control circuit 21 to control electrodes of the delay control signal generators 22-1 . . . 22-3 as shown in FIG. 2A and FIG. 8A respectively, instead of connections to oscillators 11 or 11'. The above has been explained about the case where the formant filter 15 comprises the four filters 15-1 . . . 15-4, but there is no specially noticeable change in tone color, though the characteristic curve becomes one designated by $F_3'$ even where the fourth filter 15-4 is omitted (FIG. 4A). Also, there is no specially noticeable change in tone color even where the third and the fourth filters 15-3, 15-4 are replaced by a single filter having its resonance frequency at or near 3000 Hz. The above has been also explained about the case where the sawtooth wave is used, but, instead of the sawtooth wave, a pulse wave having its duty factor in the range of 10:1–10:4 may be used.

In this case, as shown in FIG. 9, the main oscillator is a rectangular wave type oscillator and an output thereof is frequency-divided by respective frequency-dividers 12-1, 12-2, . . . so that symmetrical rectangular waves may be obtained. Circuits for connecting the respective frequency-dividers 12-1, 12-2 . . . to respective key-switches 13, 13 . . . are provided with respective duty factor changing circuits 40,40 . . . , interposed therein. The changing circuit 40 comprises a differentiation circuit **40*a* and a transistor 40*b*, for instance, as shown in FIG. 10, so that a differentiated pulse $a_1$ produced by rising of a rectangular wave a is applied to the base of the transistor 40*b* and thereby a pulse wave $a_2$ corresponding to the differentiated pulse $a_1$ is obtained at an output terminal 40c. The width of the pulse wave $a_2$ is set by the capacity of a condenser and the value of a resistance in the differentiation circuit 40a**.

Figure 11:
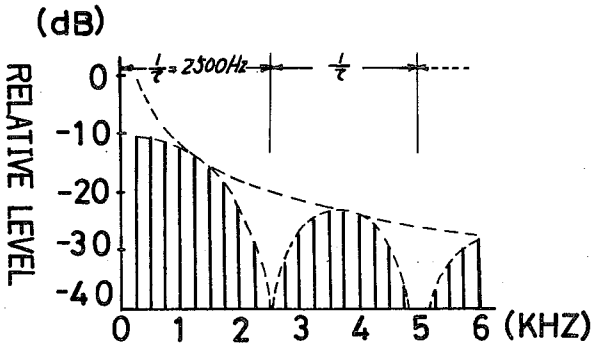
FIGS. 11 and 12 are harmonic overtone configuration diagrams of pulse waves.
Figure 12:
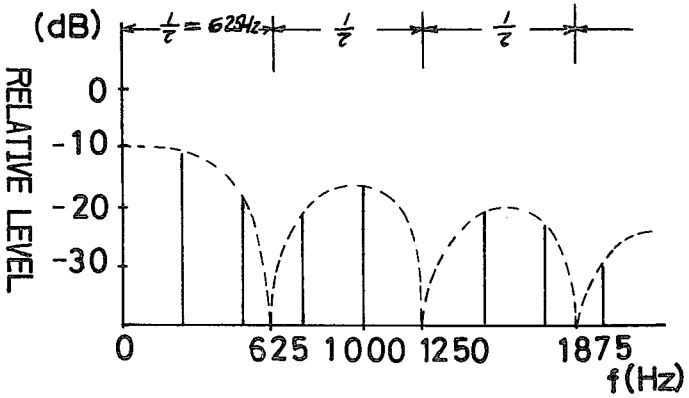

The pulse wave of 10:1 in duty factor thus obtained has its harmonic overtone configuration as shown in FIG. 11 in the case when the fundamental frequency is 250 Hz. The pulse wave of 10:4 in duty factor has its harmonic overtone configuration as shown in FIG. 12 in the case when the fundamental frequency is 250 Hz.

Namely, in the former case, if T is period, $\tau$ is pulse width, f is fundamental frequency, and fd is frequency at the first dip point, $$T=1/f=1/250=0.004(\text{sec.})$$

$$\tau=0.004/10=0.4(\text{ms})$$

$$fd=1/\tau=1/0.4=2500 \text{ Hz, and}$$

dips are produced at 2500 Hz, 5000 Hz, 7500 Hz . . . .

In the latter case, there is obtained $$\tau=4\times0.004/10=1.6 \text{ ms}$$

$$fd=1/\tau=1/1.6=625 \text{ Hz, and}$$

dips are formed at 625 Hz, 1250 Hz, 1875 Hz . . . .

In the former case, the level is somewhat lower at 2600 Hz, but voice sound of remarkably closer resemblance to the voice sound "A" than than obtained in the case of the sawtooth wave can be obtained, and in the latter case, the level at 1200 Hz is low but the sound which has much closer resemblance to the human voice sound "A" can be obtained similarly to the above case. Almost the same results can be obtained also in the cases of respective pulse waves within the range of 10:1–10:4 in duty factor. Additionally, the same results can be obtained also in the cases of other fundamental frequencies of 200–1200 Hz.

The reason why the pulse wave is more effective than the sawtooth wave in obtaining a sound closely resembling the human voice sound "A" is not clear, but as FIG. 3 and FIGS. 11 and 12 are compared, the curve in FIG. 3 has more rapid damping of the relative level than those in FIGS. 11 and 12 and thus it can be presumed that the lower harmonic overtones play a larger part.

The duty factor changing circuit 40 can be used also as a gate circuit in the place of the key-switch 13. Namely, if, as shown in FIG. 13, a key-switch 13' is interposed in a circuit connected between the collector of the transistor 40b and an electric source E, the transistor 40b is operated to be ON and OFF by a cooperation of the differentiated pulse $a_2$ and the key-switch 13', and thus a pulse wave $a_2$ can be obtained in almost the same manner as in the case of FIG. 10.

Figure 14:
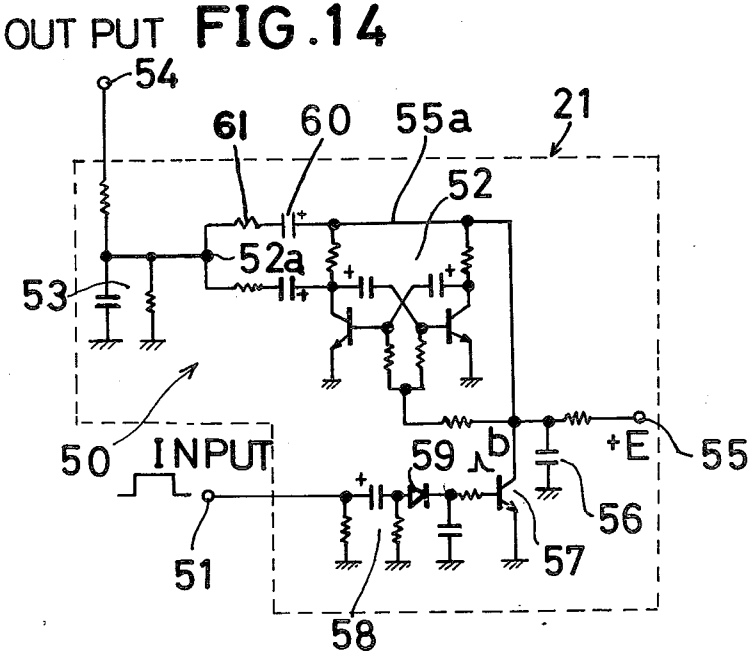
FIG. 14 is another circuit diagram of the sound production initial stage change control signal generating circuit.

FIG. 14 shows another embodying example of the voice production initial stage change control signal generating circuit 21. The same circuit 21 includes a vibrato oscillator 50 so that when a keying signal is applied to its input terminal 51, a vibrato signal may be given a fluctuation or disorder.

Namely, the vibrato oscillator 50 comprises an astable multivibrator 52 and an integration circuit 53 connected to an output terminal thereof, and an output terminal 54 of the integration circuit 53 is connected to a control electrode of the main oscillator 11 (not illustrated). A condenser 56 and a transistor 57 are interposed between an electric source connecting circuit 55 of the astable multivibrator 52 and ground, and an output terminal of the keying signal generator 20 is connected to the base of the transistor 57 through a differentiation circuit 58 and a diode 59.

When a keying signal is generated, a positive pulse b produced by the differentiation of this signal thereof is applied to the transistor 57 and thereby the transistor 57 becomes switched ON, causing the condenser 56 to discharge; thereby the potential of the electric source of the astable multivibrator 52 becomes zero. As a result, the astable multivibrator 52 stops oscillating. If, then, the transistor 57 becomes switched OFF again, the condensor 56 is gradually charged and the oscillation is gradually started, and thus a vibrato signal having a disorder as shown by solid lines in FIG. 15 is attained at the output terminal 55.

For enlarging the amount of this disorder, a modification can be considered that, for instance, a resistance 61 and a condenser 60 are interposed as shown by dotted lines between the output terminal 52a of the astable multivibrator 52 and the electric source circuit 55a.

Figure 15:
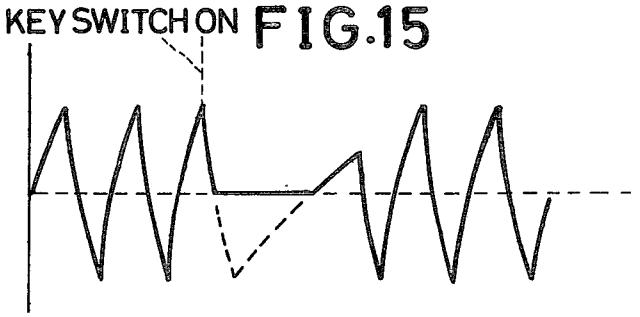
FIG. 15 is a diagram showing output characteristics of the circuit of FIG. 14.

In this case, at the time of usual oscillation, the condenser 60 is charged, so that it is not different from the steady state shown by solid lines in FIG. 15. However, when the transistor 57 becomes switched ON, the voltage of the output terminal 55 is lowered considerably through the resistance 61 and the condenser 60, and then the two condensers 56, 60 are charged, so that the change thereof is made as shown by dotted lines in FIG. 15. Thus, the vibrate is given a large disorder and thereby a sufficiently large generation initial stage change can be given.

The foregoing low frequency oscillator 23 for control of the delay circuits 16-1 . . . 16-3 comprises two oscillators 23a, 23b as shown by dotted lines in FIG. 2; 23a oscillates at 1 Hz and 23b oscillates at 5 Hz. Output terminals of the two are connected together, so that the two frequencies are overlapped and thereafter are applied to the phase-shift circuit 24. (This is a known technique.) Via the phase-shift circuit 24, the fundamental wave of each oscillator is given a phase-shift by 120 degrees for being applied to the delay circuits 16-1 . . . 16-3. This low frequency gives a complicated delay change to the musical tone signal and improves the chorus effect, due to a large change in delay time in each fundamental wave and a small change in delay time in the overlapped wave forms.

Figure 16:
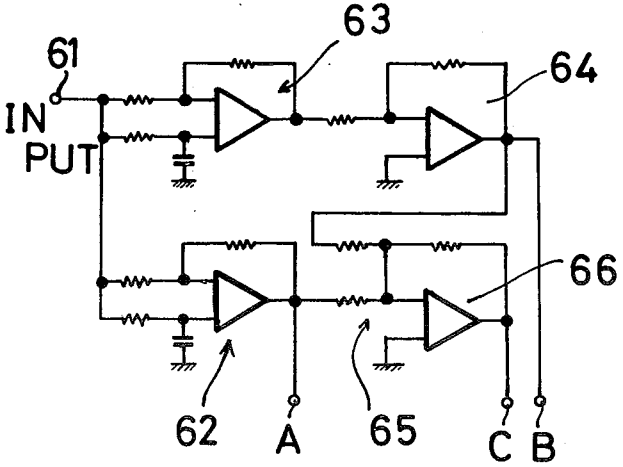
FIG. 16 is a circuit diagram of a phase shift circuit.

The phase-shift circuit 24 is constructed as shown in FIG. 16. Namely, a constant gain phase circuit 62 having a phase delay of $\pi/2$ radian and a constant gain phase circuit 63 having a phase delay of $\pi/6$ radian are connected to an input terminal 61, and an output terminal of the constant gain phase circuit 63 is connected to a phase inversion circuit 64, and an output terminal of the inversion circuit 64 and an output terminal of the constant gain phase circuit 62 are connected to an addition circuit 65, and an output terminal thereof is connected to an inversion circuit 66.

Figure 17:
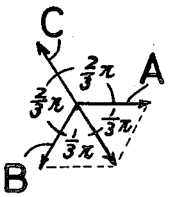
FIG. 17 is a vector diagram of outputs of the phase shift circuit of FIG. 16.

Thus, the low frequency signals differing from each other in phase by 120 degrees each, as shown by vectors A,B,C in FIG. 17, are obtained at output terminals A,B,C of the constant gain phase circuit 62 and the inversion circuits 64,66. The constant gain phase circuits 62,63 and the inversion circuits 64,66 are constructed from one using an operational amplifier.

What we claim is:

1. Apparatus for chorus effect in an electronic musical instrument comprising: a musical tone signal generator; a passing circuit for a musical tone signal obtained from said musical tone signal generator; a plurality of variable delay circuits connected to said passing circuit; a plurality of delay control signal generators for generating a plurality of delay control signals, said variable delay circuits being individually controlled by said plurality of delay control signals generated by said delay control signal generators; said passing circuit for the musical tone signal having a formant filter interposed therein and a keying signal generating circuit; a voice production initial stage change control signal generator having an output terminal; an output terminal on said keying signal generating circuit and being connected to said voice production initial stage change control signal generator; said output terminal of said voice production intial stage control signal generator being connected to said musical tone signal generator.

2. Apparatus as defined in claim 1 wherein said voice production initial stage change control signal generator comprises a network generating, upon actuation by a keying signal generated by said keying signal generating circuit, a control signal substantially disordered from its steady state and then damped to restore to the steady state.

3. Apparatus as defined in claim 1 wherein said voice production initial stage change control signal generator includes a low frequency oscillator for generating a vibrato signal, said vibrato signal being disordered by a keying signal generated by said keying signal generating circuit.

4. Apparatus as defined in claim 1 wherein said musical tone signal generated by said musical tone signal generator comprises a sawtooth wave.

5. Apparatus as defined in claim 1 including means for changing said musical tone signal generated by said musical tone signal generator into a pulse wave of 10:1–10:4 in duty factor.

6. Apparatus as defined in claim 1 wherein said formant filter comprises four filters having their respective resonance points at substantially 800 Hz, 1200 Hz, 2600 Hz and 3200 Hz.

7. Apparatus as defined in claim 1 wherein said formant filter comprises three filters having their respective resonance points at substantially 800 Hz, 1200 Hz and 3000 Hz.

8. Apparatus for chorus effect in an electronic musical instrument comprising: a musical tone signal generator; a passing circuit for a musical tone signal obtained from said musical tone signal generator; a plurality of variable delay circuits connected to said passing circuit; a plurality of delay control signal generators for generating a plurality of delay control signals, said variable delay circuits being individually controlled by said plurality of delay control signals generated by said delay control signal generators; said passing circuit for the musical tone signal having a formant filter interposed therein and a keying signal generating circuit; a voice production initial stage change control signal generator having an output terminal; an output terminal on said keying signal generating circuit and being connected to said voice production initial stage change control signal generator; said output terminal of said voice production initial stage control signal generator being connected to said delay control signal generators.

* * * * *